US008105118B2

(12) United States Patent
Claprood, Jr.

(10) Patent No.: US 8,105,118 B2
(45) Date of Patent: Jan. 31, 2012

(54) TORQUE RESISTANT TERMINAL BLOCK ELEMENT

(75) Inventor: Edward J. Claprood, Jr., West Boylston, MA (US)

(73) Assignee: Illinois Tool Works Inc., Glenview, IL (US)

( * ) Notice: Subject to any disclaimer, the term of this patent is extended or adjusted under 35 U.S.C. 154(b) by 61 days.

(21) Appl. No.: 12/853,111

(22) Filed: Aug. 9, 2010

(65) Prior Publication Data

US 2011/0097947 A1 Apr. 28, 2011

Related U.S. Application Data

(60) Provisional application No. 61/254,092, filed on Oct. 22, 2009.

(51) Int. Cl.
*H01R 9/22* (2006.01)

(52) U.S. Cl. ..... 439/709; 439/801

(58) Field of Classification Search ..... 439/709, 439/801, 444, 781, 782, 810–815, 718, 746
See application file for complete search history.

(56) References Cited

U.S. PATENT DOCUMENTS

| | | | | |
|---|---|---|---|---|
| 4,630,882 | A * | 12/1986 | Naylor et al. | 439/444 |
| 4,669,806 | A * | 6/1987 | Fuchs | 439/712 |
| 4,900,259 | A * | 2/1990 | Ludwig et al. | 439/107 |
| 7,404,745 | B1 * | 7/2008 | Wu | 439/811 |
| 7,559,810 | B1 * | 7/2009 | Wu | 439/801 |
| 7,798,869 | B1 * | 9/2010 | Konopacki et al. | 439/812 |
| 2006/0035532 | A1 * | 2/2006 | Lu | 439/709 |

* cited by examiner

*Primary Examiner* — Edwin A. Leon
(74) *Attorney, Agent, or Firm* — Mark W. Croll; Paul F. Donovan

(57) ABSTRACT

A screw terminal and a terminal block incorporating the same provides a mechanically a screw terminal frame with a closed perimeter that resists deformation of the terminal frame when a captured nut is being clamped against a wire within the terminal frame, allowing the captured nut to be clamped more tightly against the wire. Sidewalls of the terminal frame may include tabs that engage ledges of a block housing to support the screw terminal and the captured nut may have surface irregularities upon the surface that engages the wire and to improve electrical contact therebetween and resist mechanical pull out of the wire.

16 Claims, 4 Drawing Sheets

TORQUE RESISTANT TERMINAL BLOCK ELEMENT

CROSS REFERENCE TO RELATED APPLICATION

This Non-Provisional Application claims benefit to U.S. Provisional 61/254,092 filed Oct. 22, 2009 and hereby incorporated by reference.

FIELD OF THE INVENTION

The present invention relates generally to electrical terminals providing a releasable mechanical and electrical connection to a current-carrying wire and, in particular, to a screw terminal in which the connection is made by tightening a machine screw.

BACKGROUND OF THE INVENTION

Electrical screw terminals, normally as part of a terminal block, provide a versatile and reliable method of making electrical connections. The quality of the connection to a screw terminal, both in terms of providing low electrical resistance and high mechanical stability, is increased by increasing the clamping force of the nut on the wire. Increased clamping force may be obtained by applying greater torque to the machine screw. However, known screw terminals and terminal blocks are limited with respect to how much screw tightening torque they can accept and are correspondingly limited with respect to how much clamping force the screw terminals can apply to a wire.

In a simple terminal block, each screw terminal includes an electrically conductive machine screw which is threadably received by the terminal body. The wire to be connected is captured under the head of the machine screw as the machine screw is tightened.

In these simple terminal blocks, tightening the screw beyond a certain extent can squeeze the wire at least partially out from under the screw head. For multi-strand wires, this may reduce the number of strands that are mechanically held by the screw and compromise the electrical connection between the wire and screw terminal. For single-strand wires, this may completely remove the wire from its connection with the screw terminal, requiring an installer to loosen the screw and start over with connecting the wire to the terminal.

More sophisticated screw terminals employ enclosed channels into which the wire may be inserted to be captured between one wall (a clamping wall) of the channel and a threaded nut within the channel. Multiple terminals of this type may be held in an electrically insulating housing having barrier walls between terminals to form a terminal block. The nut may be guided by flanking walls of the channel to prevent its rotation as the machine screw is loosened or tightened. The channel may provide a lip opposite the clamping wall to retain the nut on the machine screw when the nut is loosened.

All such potential issues associated with existing screw terminals can compromise the clamping force that is applied to the wires and correspondingly compromise the integrity of the electrical connection. This can lead to device malfunction that may require field service calls by technicians to resolve and/or other downsides.

SUMMARY OF THE INVENTION

The present inventor has recognized that in channel-type screw terminals, tightening the screw beyond a certain extent can force the nut to rotate within the channel and push out the channel walls, away from each other. This distorts the channel which may loosen the connection between the screw terminal and the terminal housing. When the nut rotates in the channel, it is turning in unison with the screw, whereby it is not further advancing along the screw and not increasing the clamping force on the wire.

The inventor has also recognized that in such channel-type screw terminals, standard nuts are used which may be relatively thin in some screw terminals. Thin or short nuts have relatively few threads so that tightening the screw beyond a certain extent may strip the threads from the nut, rendering the screw terminal unusable.

Furthermore, the inventor has recognized that terminal blocks having channel-type screw terminals which require the nuts to be pulled up toward the screw head can be difficult to visually differentiate from those having screw terminals that require the nuts to be pushed away from the screw head. That is because many terminal blocks have small windows through which the wires are inserted into the screw terminals, while the particular mechanical configurations of the nuts, screws, and channels of the screw terminals are mostly covered by terminal blocks. Correspondingly, at times, assemblers mistakenly place wires underneath nuts in channel-type screw terminals, so that the wires get pinched between the nuts and the window perimeter edges instead of the nuts and the respective clamping walls.

The present inventor has developed screw terminals and corresponding terminal blocks that can apply larger clamping forces to wires while avoiding numerous problems that have previously been associated with trying to apply higher torques to the screws. The particular configuration(s) of the screw terminal and terminal block allow the machine screws to be tightened more than could previously be done, without compromising the interaction of the nut, the screw, and the clamping wall.

Specifically, the present invention provides an electrical screw terminal that includes a blade for connecting the electrical screw terminal to a receptacle that is provided in an electrical circuit. A terminal frame is connected to the blade and has a closed perimeter with an inner space defined within the closed perimeter. The inner space of the terminal frame houses a captured nut that moves along a screw when the screw is rotated. The closed perimeter of the terminal frame defined, at least in part by an upper wall, a pair of side walls extending from the upper wall, and a base wall extending between and connecting the side walls to each other at their lower ends.

It is thus one object of the invention to provide an electrical screw terminal of simple construction with a closed perimeter terminal frame that anchors its side walls together at their upper and lower ends, mitigating the extent to which a captured nut can within the terminal frame and push the side walls away from each other. This may increase how much clamping force the captured nut applies to a wire because rotation of the screw is substantially converted into linear movement of the captured nut along the screw. Therefore, the captured nut may move along the length of the screw in preference to rotating the captured nut and bending out the sidewalls of the terminal frame.

The base wall may include (i) an upright base wall portion that extends generally parallel to the side walls, and (ii) an angled base wall portion that extends generally angularly with respect to the side walls. The terminal frame may include a pair of lips extending from the side walls toward each other and connecting the side walls to the upright and angled base wall portions of the terminal frame.

It is thus another object of the invention to provide an electrical screw terminal with multiple base wall portions, at least one of which extends angularly with respect to the side walls. The angled base wall portion may serve as an angled gusset or brace that adds rigidity to the terminal frame. The pair of lips connects the side and base wall portions to each other, which may further add to the rigidity of the terminal frame. The rigidity of the terminal frame may help hold the side walls a constant distance from each other, ensuring that the sidewalls do not bend out to accommodate rotation of the captured nut, and resist folding, buckling over, or collapsing of the terminal frame. This may allow greater downward pressure and torque to be applied to the screw while installing a wire into the screw terminal, increasing the amount of clamping force applied to the wire.

The terminal frame may also include a finger extending between and fixing the upright and angled base wall portions with respect to each other, anchoring the side walls at a constant distance with respect to each other. An aperture may extend through at least one of the blade and the upright base wall portion and the finger may extend through the aperture. An end of the finger may be bent to define a J-shaped profile with the bent end pointing upward toward the terminal frame.

It is thus another object of the invention to provide an electrical screw terminal with upright and angled base wall portions that are mechanically attached to each other or to other components or portions of the screw terminal. This may prevent relative sliding movement and bending of portions of the screw terminal with respect to each other and may maintain the integrity of the terminal frame so that the side walls of the frame do not bend outwardly and thus may also mitigate tendencies of the captured nut to rotate between the side walls.

The captured nut may include a top wall with an irregular surface. The irregular surface of the captured nut top wall may include multiple ridges. The ridges may extend in a direction that is generally orthogonal to the wire that is held in the screw terminal.

It is thus another object of the invention to provide an electrical screw terminal with a capture nut that includes ridges, grooves, or other surface irregularities that can engage or bite into the wire. This configuration increases the surface area of the interface of the captured nut and wire and may supplement the holding ability of the screw terminal so that a greater pulling force would be required to withdraw the wire from the screw terminal.

The electrical screw terminal may be provided within a terminal block that includes a housing which is made from an insulating material that at least partially covers the electrical screw terminal. The housing of the terminal block includes an opening that aligns with the inner space of the terminal frame. The captured nut is movable between (i) an open position in which a passage extends through the opening of the housing and into the inner space of the terminal frame, allowing the wire to insert through the housing and into the terminal frame, and (ii) a closed position in which the captured nut extends across substantially the entire opening of the housing, preventing the wire from inserting into the terminal frame.

It is thus another object of the invention to provide a terminal block with a captured nut that is tall enough to substantially cover the opening through the housing when the captured nut is tightened without a wire in the screw terminal. This may ensure that the wire is inserted on the appropriate side of the nut and the relatively taller nut may have more threads that can accommodate greater forces in its thread engagement with the screw, allowing the nut to apply greater clamping forces to the wire.

The housing may include a top wall that retains the screw from above. The housing may also include a ledge that supports the screw terminal by an engagement of a tab that extends from the terminal frame and the ledge. The screw terminal is vertically maintained within the housing, between the housing top wall, and the ledge.

It is thus another object of the invention to provide a terminal block that can prevent the screw from being completely removed from the capture nut. It is another object of the invention to provide a terminal block with a robust support that can hold the screw terminal in a vertical direction, allowing move downward force to be applied to the screw when rotating it, which may result in more torque being applied to the screw without the tool slipping out of the screw.

Other features and advantages of the invention will become apparent to those skilled in the art upon review of the following detailed description, claims, and drawings in which like numerals are used to designate like features.

Figure 1:
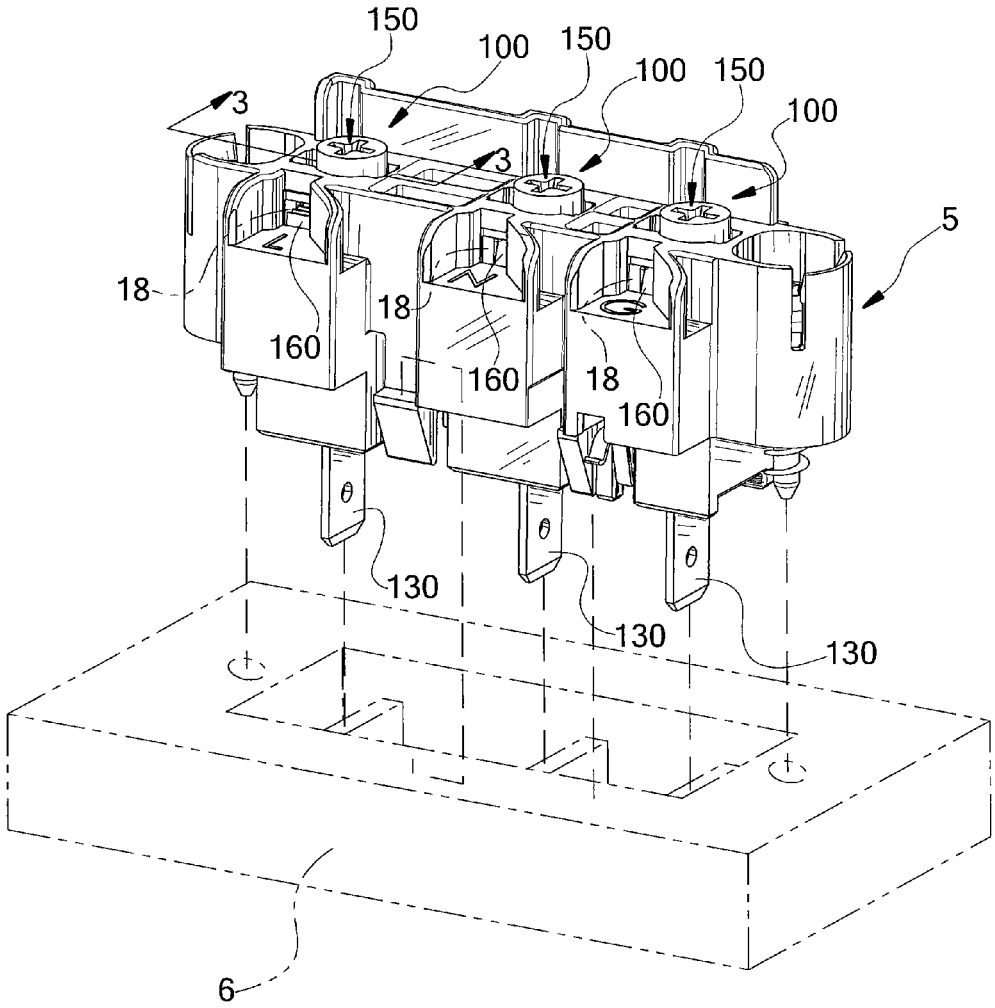
FIG. 1 is a perspective view of a terminal block of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 2:
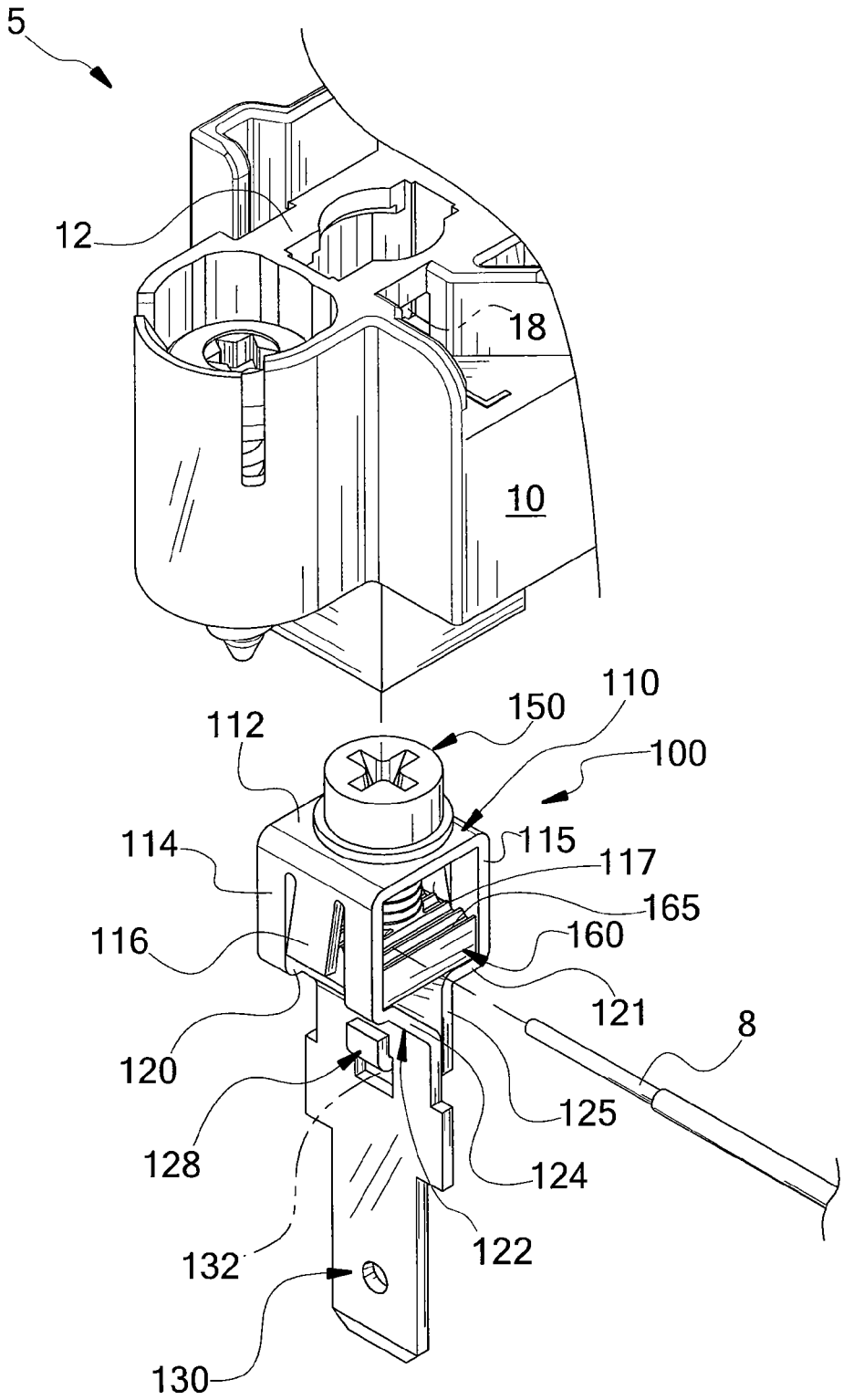
FIG. 2 is an enlarged pictorial and exploded view of a portion of the terminal block of FIG. 1 cross-section along line 2-2 in FIG. 1.

FIGS. 1 and 2 each shows a terminal block 5 or portion thereof that is configured for electrically connecting wires 8 to a receptacle 6 in an electronic device or system. Terminal block 5 includes a housing 10 which holds at least one screw terminal 100. As shown in FIG. 2, each screw terminal 100 includes a generally box-shaped frame 110 from which a conductive blade 130 extends and that has open ends and an inner space that holds a captured nut 160 that is movable along a screw 150, explained in greater detail elsewhere herein.

Referring now to FIG. 1, this particular embodiment of housing 10 holds three screw terminals 100. The three illustrated screw terminals 100 are provided to connect wires 8 to the line "L", neutral "N", and ground "G" conductors of an electrical circuit(s). This configuration can be used with, for example, circuits carrying about 20 A at about 300V, or others, based on the particular end-use configuration of the electronic device or system.

Still referring to FIG. 1, the housing 10 of block 5 is made from an insulating material and at least partially covers each of the electrical screw terminals 100, which are made from a suitably electrically conductive metallic material(s). Only blades 130 and screws 150 are readily accessible from outside of the housing 10. Blades 130 insert into conductive sockets of the receptacle 6 that are part of the corresponding electrical circuit(s) to connect the screw terminals 100 and thus also terminal block 5 to the end use device or system.

Referring yet further to FIG. 1, the illustrated housing 10 includes cylindrical screw bosses at its ends. Mounting screws extend through to secure the block 5 to the receptacle 6. The front of housing 10 includes flexible tabs that interlock with or snap-fit into corresponding structures of the receptacle 6, which helps hold the block 5 to the receptacle 6. A release lever is provided by one of the flexible tabs that facilitates removal of the block 5 from the receptacle 6. Portions of the housing 10 that hold the screw terminals 100 are spaced from each other by parallel and upright support webs.

Figure 3:
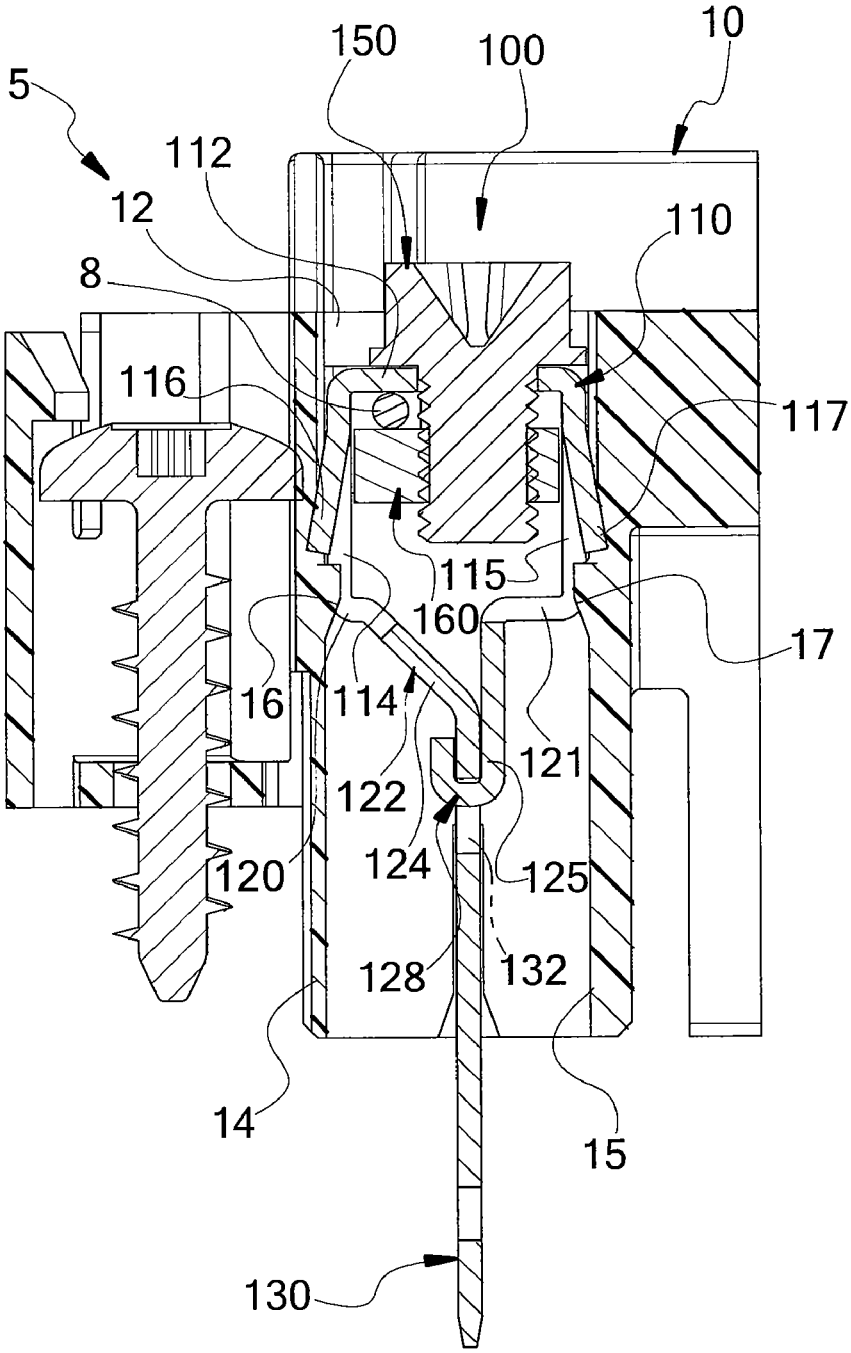
FIG. 3 is a sectional view of the terminal block of FIG. 1 taken generally in the plane indicated by line 3-3 in FIG. 1.

Referring now to FIG. 3, the respective portions of the housing 10 that confine the screw terminals 100 each includes a top wall 12 that overlies the respective screw terminal 100, so as to prevent removal of the screw terminal 100 from the top of the block 5. In this embodiment, top wall 12 has a hole through which part of the head of screw 150 extends. A flange that radiates from the bottom of the screw 150 head nests inside of a curved undercut in the bottom of the top wall 12. FIG. 2 shows the undercut as a step at the bottom of the curved back edge of the opening in top wall 12. Preferably, the top wall 12 retains the screw 150 within the housing 10 so that when the nut 160 is pushed all the way down toward the blade 130, the screw 150 still extends into the nut 160. In this configuration, the screw 150 cannot be fully removed from the nut 160 when the screw terminal 100 is mounted in the housing 10.

Still referring to FIG. 3, each portion of the housing 10 that confines a screw terminal 100 includes a pair of walls 14, 15 that extend down from the top wall 12, covering most of the length of the screw terminal 100. Ledges 16, 17 extend inwardly from the walls 14, toward each other and into a void space of the housing 10 in which the screw terminal 100 sits. Ledges 16 and 17 have ramped lower surfaces that facilitate insertion of the screw terminal 100 through an opening at the bottom of the housing 10. The ledges 16, 17 include flat top surfaces that serve as shoulders against which the screw terminal 100 is supported in a vertical direction, described in greater detail elsewhere herein.

Referring again to FIGS. 1 and 2, openings 18 extend through a forward facing wall of the housing 10. The openings 18 are aligned with corresponding openings that extend into the terminal frames 110 of the screw terminals 100. This allows wires 8 to be inserted into and connected to the screw terminals 100 by way of the screws 150, nuts 160, and terminal frames 110.

Referring now to FIGS. 2 and 3, the terminal frame 110 of screw terminal 100 includes a flat upper wall 112 that abuts the bottom surface of top wall 12 of the housing. Upper wall 112 has a hole through which the treaded shaft of screw 150 extends. In this embodiment, the hole in upper wall 112 is slightly off-center, as is the longitudinal axis of screw 150, with respect to the upper wall 112.

Still referring to FIGS. 2 and 3, a pair of side walls 114, 115 extends downwardly from opposing sides of the upper wall 112. The side walls 114, 115 have tabs 116, 117 that extend outwardly to engage the ledges 16, 17 of the housing walls 14, 15 (FIG. 3). In this embodiment, the tabs extend angularly out and down from upper portions of the side walls 114, 115. This allows the tabs to deflect inwardly and slide over the lower surface ramps of the ledges 16, 17 when the screw terminal 100 is inserted into the housing 10 through the open bottom wall of the housing 10. Tabs 116, 117 are sufficiently resilient to snap out against the housing walls 14, 15 after the tabs 116, 117 have slid past the ledges 16, 17 during insertion. Accordingly, once the screw terminal 100 is installed in the housing 10, the screw terminal 100 is vertically captured between the housing upper wall 12 and the ledges 16, 17. The ledges 16, 17 provide mechanical stops against which the tabs 116, 117 wedge and sit so that downward forces applied to the screw 150 are transferred through the tabs 116, 117 into and through the ledges 16, 17 and thus into the housing walls 14, 15 distributing such forces through the housing 10.

Still referring to FIGS. 2 and 3, the overall configuration of the terminal frame 110 helps ensure that the screw terminal 100 has sufficient structural integrity to transfer such loads. The generally box-shaped configuration that defines a closed perimeter of the terminal frame 110 holds the side walls 114, 115 in a constant position which prevents the nut 160 from rotating between them. In this way, the terminal frame 110 resists the input torque being to the screw 150 and nut 160, which forces the nut 160 to move linearly along the screw 150 instead of rotating. Holding the side walls 114, 115 in constant positions also holds the tabs 116, 117 in their proper positions for engaging and being supported by ledges 16, 17.

Referring yet further to FIGS. 2 and 3, lips 120, 121 extend from the bottoms of side walls 114, 115, respectively, toward each other. Lips 120, 121 support the nut 160 from below when the nut 160 is at its bottom position or at the downward travel limit, blocking further downward travel of the nut 160, as shown in FIG. 2. In this embodiment, lip 121 extends about three times further or is about three times wider than lip 120. The end of lip 121 that is furthest from side wall 115 sits under the threaded shaft of the screw 150, whereas the end of lip 120 that is furthest from side wall 114 sits approximately under the flange of the screw 150 head.

Shown best in FIG. 3, a bottom portion of the closed perimeter of terminal frame 110 is defined by a base wall 122 that extends between and connects the side walls 114, 115 to each other. In this embodiment, the base wall 122 has multiple segments or portions that are connected or joined together to cumulatively define the base wall 122. Base wall 122 includes an angled base wall portion 124 that extends from the lip 120 and an upright base wall portion 125 that extends from the lip 121. Angled base wall portion 124 extends at approximately a 45-degree downward angle with respect to a flat upper surface of lip 120. Upright base wall portion 125 extends at approximately a 90-degree downward angle with respect to a flat upper surface of lip 121. The angled and upright base wall portions 124, 125 define an approximately 45-degree angle therebetween and converge directly under the longitudinal axis of screw 150.

Referring again to FIGS. 2 and 3, in this embodiment, the blade 130 extends continuously from the end of angled base wall portion 124. The top portion of blade 130 and the bottom portion of upright base wall portion 125 overlap each other or sit in face-to-face communication at such portions. An aperture 132 extends through the top portion of blade 130. Finger 128 extends continuously from the end of upright base wall portion 125, through the aperture 132, and includes a bent end that engages an outwardly facing surface of the blade 130. In this embodiment, the bent end of finger 128 bends upwardly, toward the terminal frame 110 so that the upright base wall portion 125 and the finger 128 define a J-shaped cross-section. In other embodiments, finger 128 has no discernable bent end or is bent toward some other direction, for example, downwardly, forward, rearward, or otherwise, depending on the particular end-use configuration of the screw terminal 100.

Shown best in FIG. 2, blade 130 extends as a planar strip of material from the terminal frame 110. Blade 130 includes opposing rectangular projections that extend from front and back edges of the blade 130 and are received in corresponding grooves of frontward and rearward facing walls of the housing 10. Regardless of the particular configuration of blade 130, it is configured for receipt into a conductive socket or other electrical component of the end-use device to electrically couple the wire 8 to an electrical circuit of such device, the wire 8 being clamped in the screw terminal 100 with the nut 160. Therefore, although blade 130 includes not only planar strips of conductive material, but also, for example, conductive pins, conductive posts, and/or other conductive hardware depending on the particular end use configuration of the block 5 and/or receptacle 6.

Referring again to FIGS. 2 and 3, preferably the entire screw terminal 100, with the exception of screw 150 and nut 160, is made from a single continuous piece of electrically conductive material. In such configuration, the screw terminal 100 may start from a single piece of material that is, for example, punched, blanked, and then braked or otherwise bent to form the entire assemblage of screw terminal 100. Accordingly, screw terminal 100 may be formed from generally flat material blanks that have the blade 130 at one end and the finger 128 at the other end. The material that will form the angled base wall portion 124, lip 120, side wall 114 and tab 116, upper wall 112, side wall 115 and tab 117, lip 121, and base wall upright portion 125 extends between the blade 130 and finger 128. Such material is then bent at respective locations along its length to create the corners defined between the various segments in order to arrive at the unitary screw terminal 100 as illustrated, with the bottom wall 122 joining the bottoms of the side walls 114 and 115 together to define the closed perimeter of terminal frame 110 that restricts rotation of nut 160 while allowing the nut 160 to travel vertically therethrough.

Figure 4:
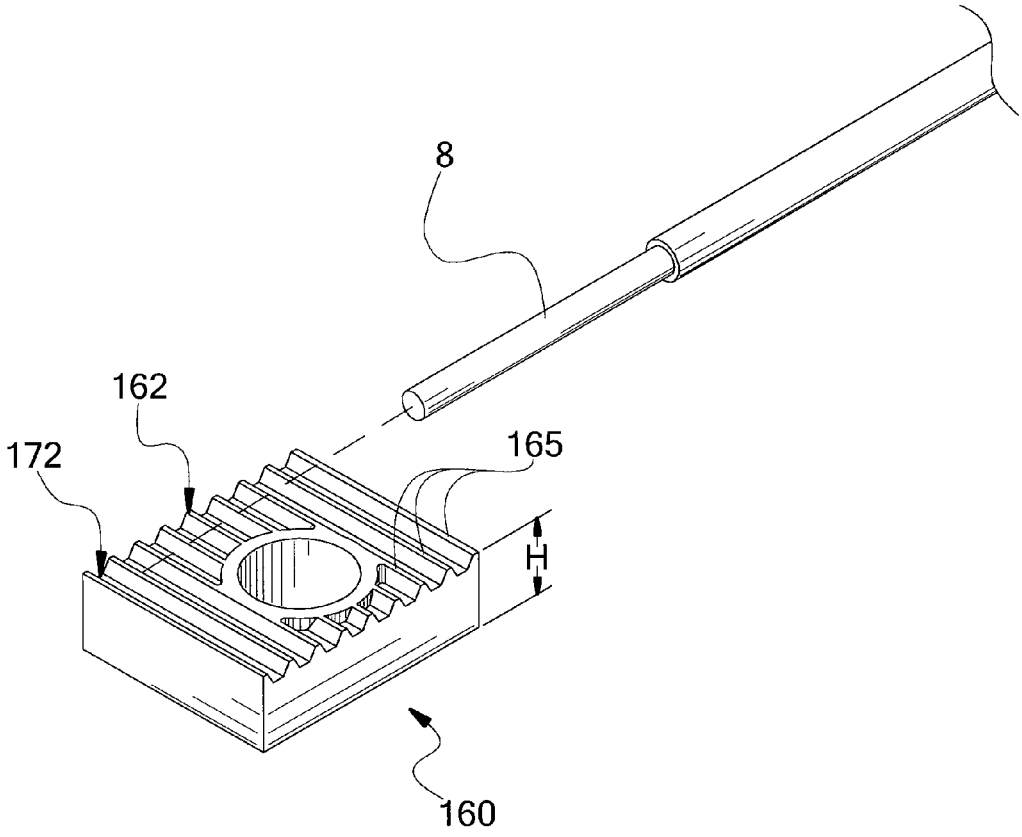
FIG. 4 is a perspective view of a captured nut of the terminal block of FIG. 1.

Referring now to FIGS. 1 and 4, nut 160 has a generally rectangular perimeter shape and defines a tallness, thickness, or height dimension "H" which is shown in FIG. 4. In this embodiment, height "H" is greater than a height dimension of opening 18 of the block housing 10. Best shown in FIG. 1, referring to the neutral "N" and ground "G" associated screw terminals 100, such screw terminals 100 have nuts 160 that are in a closed position. The nuts 160 in the closed position are screwed all the way up against the upper wall 112 of the terminal frame 110. In this position, since the height "H" of nut 160 is greater than the height of opening 18, the opening 18 is completely blocked by the nut 160 from inside of the screw terminal 100, fully preventing the wire 8 from being inserted into the screw terminal 100 in any way. Referring to the line "L" associated screw terminal 100, in this screw terminal 100, the nut 160 is in an open position in which it is spaced from the upper wall 112 of the terminal frame 110. When the nut 160 is in such an open position, a passage is defined through the opening 18 of the housing 10, above the nut 160, and into the inner space of the terminal frame 110. Wire 8 can be inserted into the screw terminal 100 when the nut 160 is in the open position, such as that associated with line "L", as shown in FIG. 1.

In other embodiments, the height "H" of nut 160 is not large enough to completely cover the opening 18. However, in such embodiments, it is preferred that any gap which is defined between the edges of opening 18 and nut 160, when the nut is in a closed position, is too small for the wire 8 to fit into. This may reduce the likelihood of the wire 8 being installed improperly into the screw terminal 100, with the wire 8 being on the wrong side of the nut 160.

Referring now to FIG. 4, in this embodiment, nut 160 includes a top wall that has an irregular surface 162. The irregular surface 162 of this top wall is in the form of multiple ridges 165 that extend parallel to each other. A direction of extension of the ridges 165 is orthogonal to the longitudinal axis of the wire 8, so that the ridges 165 engage the outer circumferential surface of the wire 8 in a crosswise manner.

Ridges 165 are configured to create transversely extending localized deformations in the wire 8. This increases the surface area of the interface between the wire 8 and nut 160 and provides a wavy or toothed mechanical interlock therebetween. Although the ridges 165 can deform the wire 8, the top surfaces of ridges 165 are blunt enough to prevent them from shearing through the wire 8 when clamping the wire 8 into the screw terminal 100.

Still referring to FIG. 4, in this embodiment, the ridges 165 have flat surfaces and are defined between pairs of adjacent grooves 172. The grooves 172 of the illustrated embodiment have flat bottom walls. Each groove 172 includes a pair of slanted side walls that extend from the groove bottom wall, away from each other, and connect the bottom wall to the adjacent ridges 165 on opposing sides of the groove 172. Ridges 165 of this embodiment are about half as wide as the bottom walls of the grooves 172. In one embodiment, bottom walls 172 are about 0.010 inch to about 0.020 inch wide, preferably about 0.015 inch wide and ridges 165 are about 0.006 inch to about 0.012 inch wide, preferably about 0.008 inch wide. The depth of the grooves 172 can be about the same as the width of the flat bottom walls of the grooves 172, optionally less deep, for example, about 0.006 inch in depth. Of course, irregular surface 162 in some embodiments has other configurations besides ridges 165 and grooves 172. For example, the irregular surface 162 can be defined by knurling, bumps, and/or other surface irregularities which may enhance the ability of the screw terminal 100 to hold wire 8 without shearing it.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An electrical screw terminal, comprising:

a conductive blade for connecting the electrical screw terminal to a receptacle that is provided in an electrical circuit;

a terminal frame connected to the blade and having a closed perimeter with an inner space defined within the closed perimeter, the closed perimeter of the terminal frame defined at least in part by;

an upper wall;

a pair of side walls extending from the upper wall; and a base wall joining the side walls to each other;

a screw extending into the inner space of the terminal frame and being rotatable from outside of the terminal frame;

a captured nut housed in the inner space of the terminal frame and engaging the screw such that the captured nut moves linearly along the screw when the screw is rotated; and wherein the side walls restrict rotation of the captured nut and are maintained at a constant distance from each other at opposing ends thereof by the upper and base walls, respectively.

2. The electrical screw terminal of claim 1, the base wall further comprising (i) an upright base wall portion that extends generally parallel to the side walls, and (ii) an angled base wall portion that extends generally angularly with respect to the side walls.

3. The electrical screw terminal of claim 2, the terminal frame further comprising a pair of lips extending from the side walls into the inner space of the terminal frame, the lips connecting the side walls to the upright and angled base wall portions of the terminal frame.

4. The electrical screw terminal of claim 2, further comprising a finger extending between and fixing the upright and angled base wall portions with respect to each other.

5. The electrical screw terminal of claim 4, wherein an aperture extends through at least one of the blade and the base wall and the finger extends through the aperture so as to prevent sliding between respective facing surfaces of the blade and the upright base wall portion.

6. The electrical screw terminal of claim 5, wherein an end of the finger is bent and engages one of the blade and base wall so as to prevent at least one of (i) separation of the blade and base wall with respect to each other, and (ii) separation of the upright and angled base wall portions with respect to each other.

7. The electrical screw terminal of claim 5, wherein the finger extends from the upright base wall portion such that the upright base wall portion and finger define a J-shaped profile.

8. The electrical screw terminal of claim 1, the terminal frame further comprising a tab extending outwardly from at least one of the side walls.

9. The electrical screw terminal of claim 8, wherein the terminal frame includes a pair of tabs extending from the pair of side walls, respectively, the tabs extending angularly away from each other.

10. The electrical screw terminal of claim 1, wherein the captured nut includes a top wall defining an irregular surface thereof.

11. The electrical screw terminal of claim 10, wherein the top wall of the captured nut includes multiple ridges that engage a wire being held in the electrical screw terminal.

12. The electrical screw terminal of claim 11, wherein the ridges of the captured nut top wall extend in a direction that is generally orthogonal to the wire.

13. A terminal block, comprising:

an electrical screw terminal that includes a terminal frame having a closed perimeter with an inner space for receiving a wire and a captured nut that is housed within the inner space of the terminal frame and is movable along a screw to clamp the wire against the terminal frame;

a housing that is made from an insulating material and at least partially covers the electrical screw terminal and includes an opening that aligns with the inner space of the terminal frame; and wherein the captured nut is movable between (i) an open position in which a passage extends through the opening of the housing and into the inner space of the terminal frame allowing the wire to insert through the housing and into the terminal frame; and (ii) a closed position in which the captured nut extends across substantially the entire opening of the housing, preventing the wire from inserting into the terminal frame.

14. The terminal block of claim 13, the housing further comprising a top wall that engages a head of the screw so as to retain the screw within the housing.

15. The terminal block of claim 13, wherein the housing includes multiple interconnected walls defining a void space therebetween, the housing further comprising a ledge extending from at least one of the walls and into the void space, the ledge engaging the terminal frame of the screw terminal so as to retain the screw terminal within the housing.

16. The terminal block of claim 15, the terminal frame of the screw terminal further comprising at least one tab extending therefrom, the tab engaging the ledge of the housing so that the ledge retains the screw terminal within the housing.

* * * * *